US010968557B2

(12) United States Patent
Lee et al.

(10) Patent No.: US 10,968,557 B2
(45) Date of Patent: Apr. 6, 2021

(54) LAUNDRY TREATING APPARATUS

(71) Applicant: LG Electronics Inc., Seoul (KR)

(72) Inventors: Jihong Lee, Seoul (KR); Minkyu Sang, Seoul (KR); Byungsun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 73 days.

(21) Appl. No.: 16/233,906

(22) Filed: Dec. 27, 2018

(65) Prior Publication Data

US 2019/0194852 A1 Jun. 27, 2019

(30) Foreign Application Priority Data

Dec. 27, 2017 (KR) ..... 10-2017-0181371

(51) Int. Cl.

| | |
|---|---|
| ***D06F 37/20*** | (2006.01) |
| ***D06F 37/24*** | (2006.01) |
| *D06F 29/00* | (2006.01) |
| *D06F 37/28* | (2006.01) |

(52) U.S. Cl.

CPC ..... *D06F 37/20* (2013.01); *D06F 37/24* (2013.01); *D06F 29/00* (2013.01); *D06F 37/28* (2013.01)

(58) Field of Classification Search

None

See application file for complete search history.

(56) References Cited

U.S. PATENT DOCUMENTS

2009/0139273 A1 6/2009 Kim et al.
2014/0298866 A1* 10/2014 Hwang ..... D06F 37/06 68/139
2015/0345061 A1* 12/2015 Lee ..... D06F 37/18 68/13 R (Continued)

FOREIGN PATENT DOCUMENTS

| | | |
|---|---|---|
| CN | 101387073 | 3/2009 |
| CN | 201321564 | 10/2009 |
| EP | 2700743 | 2/2014 |

(Continued)

OTHER PUBLICATIONS

Extended European Search Report in European Application No. 18215827.9, dated Apr. 18, 2019, 9 pages.

(Continued)

*Primary Examiner* — Cristi J Tate-Sims
(74) *Attorney, Agent, or Firm* — Fish & Richardson P.C.

(57) ABSTRACT

The present invention relates to a laundry treating apparatus. The laundry treating apparatus of the present invention includes: a cabinet which forms an exterior of the laundry treating apparatus, and has one open surface; a drawer which is configured to be withdrawable from the one open surface of the cabinet and has an open top portion; a tub which is disposed inside the drawer and provides a space for storing wash water; a drum which is rotatably provided inside the tub; a door which opens and closes an open top surface of the tub; a top cover which covers the open top portion of the drawer, and is spaced apart from the door by a predetermined distance along an outer circumference of the door; and a buffer which is disposed at the tub or a part facing the tub, so as to prevent contact between the top cover and the door.

20 Claims, 11 Drawing Sheets

(56) References Cited

U.S. PATENT DOCUMENTS

2017/0002496 A1* 1/2017 Lee ..... D06F 37/26

FOREIGN PATENT DOCUMENTS

| | | |
|---|---|---|
| EP | 3112523 | 1/2017 |
| JP | 2015226770 | 12/2015 |
| KR | 100216127 | 8/1999 |
| KR | 100707475 | 4/2007 |
| KR | 100877988 | 1/2009 |
| KR | 101054409 | 8/2011 |
| KR | 1020170135113 | 12/2017 |
| WO | WO2016140484 | 9/2016 |

OTHER PUBLICATIONS

Australian Examination Report in Australian Application No. 2018286577, dated Jun. 12, 2019, 9 pages.
Chinese Office Action in Chinese Application No. 201811609023.7, dated Sep. 17, 2020, 11 pages (with English translation).

* cited by examiner

LAUNDRY TREATING APPARATUS

BACKGROUND OF THE INVENTION

1. Field of the Invention

The present disclosure relates generally to a laundry treating apparatus, and more particularly to a laundry treating apparatus which prevents contact between a top cover and a door.

2. Description of the Related Art

Generally, a laundry treating apparatus commonly refers to an apparatus for removing contaminants from clothing, bedding, and the like (hereinafter referred to as "laundry") by using chemical decomposition of water and detergent, and a physical action such as friction between water and laundry, and the like. Such laundry treating apparatus has a basic structure with a drum which is rotatably installed and accommodates laundry, and may be classified into: a front-loading type, in which clothes are put into the drum through an inlet port provided at a front surface of the apparatus; and a top-loading type, in which clothes are put into the drum through an inlet port provided at a top surface of the apparatus.

The laundry treating apparatus of the top-loading type includes a cabinet, a tub which is provided inside the cabinet and has an inlet port formed at a top surface, a drum which is rotatably provided inside the tub, and a door which opens and closes the inlet port. Further, the tub may further include a door formed at the top and connected to the tub to open and close the open top of the tub, and a top cover which covers the tub at portions other than the door.

The top cover is mounted and secured on the top of the cabinet, but the door is mounted at the tub, such that the door may be moved by the vibration of the tub. In this case, there is a problem in that when the door is moved by the vibration of the tub, the door may come into contact with the top cover, and such contact between the door and the top cover may damage the exterior of the top cover and the door, or may cause noise.

SUMMARY OF THE INVENTION

It is an object of the present invention to provide a laundry treating apparatus which may prevent contact between a door and a top cover even when a tub vibrates.

It is another object of the present invention to provide a laundry treating apparatus which may minimize noise caused by the vibration of the tub.

The objects of the present invention are not limited to the aforementioned objects and other objects undescribed herein will be clearly understood by those skilled in the art from the following description.

In accordance with an aspect of the present invention, the above and other objects can be accomplished by providing a laundry treating apparatus, including: a cabinet forming an exterior of the laundry treating apparatus, and having one open surface; a drawer that is disposed in the cabinet, the drawer being withdrawable from the one opened side of the cabinet and having an upper side opened; a tub having an upper side opened and disposed inside the drawer to provide a space for storing wash water r; a drum rotatably provided inside the tub; a door a door opening and closing the opened upper side of the tub; a top cover covering the opened upper side of the drawer, and spaced apart from the door by a predetermined distance along an outer circumference of the door; and a buffer which is disposed at the tub or a part facing the tub, so as to prevent contact between the top cover and the door.

In the laundry treating apparatus of the present disclosure, a gap between the tub and the buffer or a gap between the buffer and the part facing the tub may be formed to be shorter than a gap between the top cover and the door. Accordingly, before the top cover and the door come into contact with each other, the buffer may contact the tub or the part facing the tub.

The laundry treating apparatus may further include a protrusion member formed to narrow the gap between the tub and the buffer or the gap between the part facing the tub and the buffer. Accordingly, before the top cover and the door come into contact with each other, the buffer may contact the tub or the part facing the tub.

Specifically, as the buffer may be disposed on an inner surface of the drawer facing an outer circumferential surface of the tub, may be disposed on the outer circumferential surface of the tub, or may be disposed on an inner surface of the top cover which is coupled to a top portion of the drawer, the laundry treating apparatus of the present disclosure may prevent contact between the top cover and the door.

Further, the laundry treating apparatus may include a protrusion member disposed between the drawer and the buffer to narrow a gap between the tub and the buffer, or which is disposed on the inner surface of the drawer facing the buffer to narrow a gap between the buffer and the drawer.

In the laundry treating apparatus, the buffer may include: a first buffer for prevent contact between the door and the top cover when the door is moved forward; a second buffer for prevent contact between the door and the top cover when the door is moved leftward and rightward; and a third buffer for prevent contact the door and the top cover when the door is moved in a diagonal direction.

In addition, the drawer may include a drawer bracket formed to protrude inside the drawer to be connected to a suspension, which suspends the tub; and the third buffer may be disposed on the outer circumferential surface of the tub facing the drawer bracket.

The laundry treating apparatus may further include: a first protrusion member formed to narrow a gap between the first buffer and the tub; and a second protrusion member which is disposed on an end portion of the drawer bracket facing the third buffer, thereby secondarily preventing contact between the door and the top cover.

In the laundry treating apparatus, as the first protrusion member is disposed between the drawer panel and the first buffer, a gap D1' between the first buffer and the tub may be formed to be shorter than a gap D1 between a front portion of the door and the top cover (D1>D1').

In the laundry treating apparatus, as the second buffer is disposed at a coupling rib of the top cover, a gap D2' between the second buffer and the tub may be formed to be shorter than a gap D2 between both lateral portions of the door and the top cover (D2>D2').

Further, as the third buffer is disposed on the outer circumferential surface of the tub, and the second protrusion member is disposed on the end portion of the drawer bracket of the drawer, a gap D3' between the third buffer disposed on the outer circumferential surface of the tub and the second protrusion member disposed on the end portion of the drawer bracket may be formed to be shorter than a gap D3 between the door and the top cover (D3>D3').

The specifics of other embodiments are included in the detailed description and drawings.

Effects of the Invention

The laundry treating apparatus of the present disclosure have one or more of the following effects.

First, the laundry treating apparatus of the present disclosure has an effect in that before the door comes into contact with the top cover, the buffer contacts the tub or the part facing the tub, such that the exterior of the door or the top cover may not be damaged in the laundry treating apparatus.

Second, the laundry treating apparatus of the present disclosure also has an effect in that the door and the top cover do not come into contact with each other, such that noise caused by the contact between the door and the top cover may be reduced.

The effects of the present disclosure are not limited to the above-described effects, and other effects undescribed herein may be clearly understood by those skilled in the art from the claims.

DETAILED DESCRIPTION OF THE PREFERRED EMBODIMENTS

Figure 1:
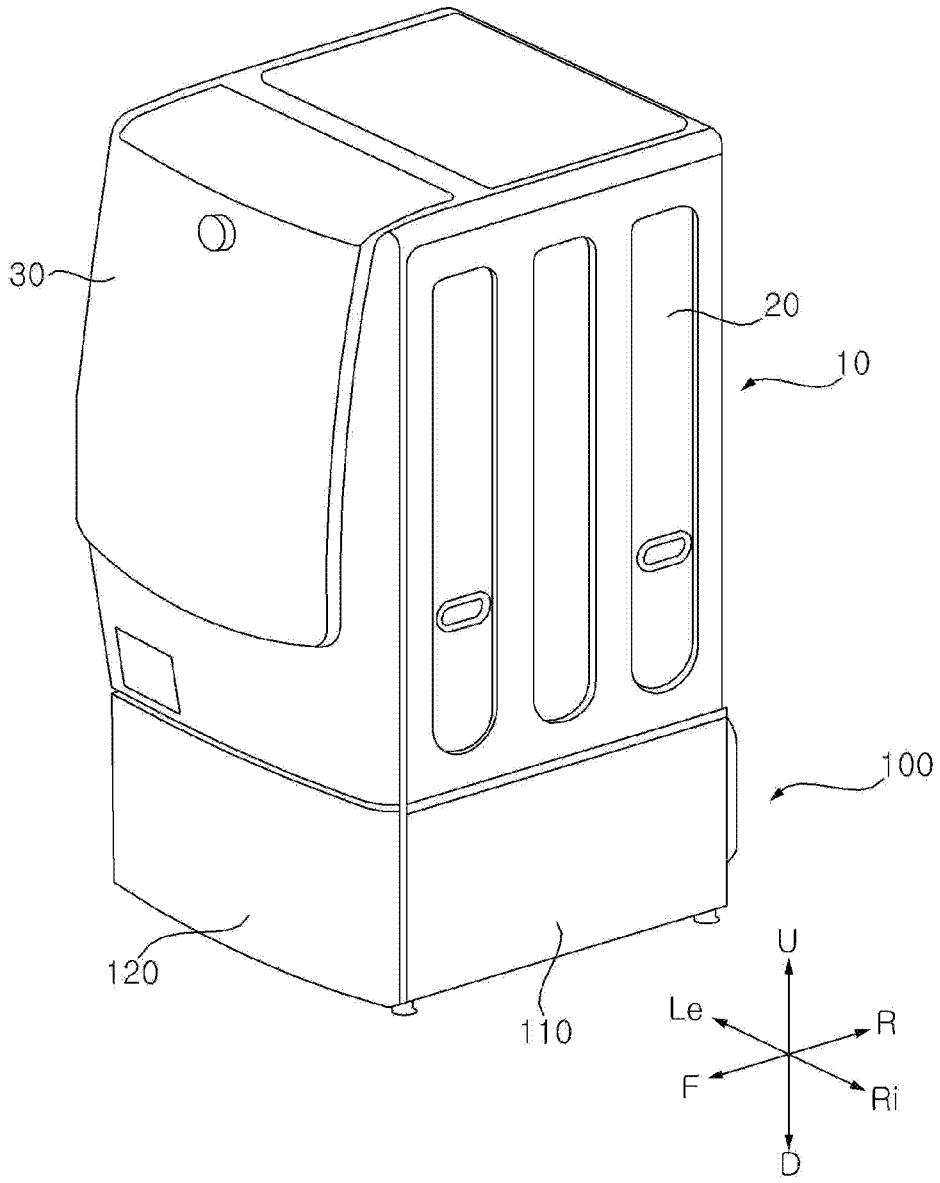
FIG. 1 is a perspective view of a laundry treating apparatus according to an embodiment of the present disclosure.

Advantages and features of the present disclosure and methods for accomplishing the same will be more clearly understood from exemplary embodiments described below with reference to the accompanying drawings. However, the present disclosure is not limited to the following embodiments, but may be implemented in various different forms. The embodiments are provided only to complete disclosure of the present disclosure and to fully provide a person having ordinary skill in the art to which the present disclosure pertains with the category of the present disclosure, and the present disclosure will be defined by the scope of the appended claims. Wherever possible, like reference numerals generally denote like elements through the specification.

In the following description, the terms indicating directions, such as "front (F)," "rear (R)," "left (Le)," "right (RI)," "upward (U)," "downward (D)," and the like, are defined based on those illustrated in the drawings, and are given only for clear understanding of the present disclosure, and each of the directions may be defined differently according to a reference direction.

Hereinafter, embodiments of the present disclosure will be described in detail with reference to the accompanying drawings for explaining a laundry treating apparatus.

<First Laundry Treating Apparatus and Second Laundry Treating Apparatus>

FIG. 1 is a perspective view of a laundry treating apparatus according to an embodiment of the present disclosure.

The laundry treating apparatus of the present disclosure is an apparatus which performs a laundry treating function such as washing, rinsing, dehydration, or drying; and may include only the first laundry treating apparatus 100, or may include the first laundry treating apparatus 100 and the second laundry treating apparatus 10 disposed above the first laundry treating apparatus 100.

Referring to FIG. 1, the laundry treating apparatus according to an embodiment of the present disclosure may include the first laundry treating apparatus 100 and the second laundry treating apparatus 10 disposed above the first laundry treating apparatus 100. However, this is merely exemplary, and the laundry treating apparatus may include only the first laundry treating apparatus 100 independently.

The second laundry treating apparatus 10 may include a second cabinet 20, which forms an exterior of the second laundry treating apparatus 10, and a second door 30 which opens and closes a front side of the second cabinet 20. Further, the second laundry treating apparatus 10 includes: a second tub (not shown) which is disposed inside the second cabinet 20 and provides a space for storing wash water: a second drum (not shown) which is rotatably disposed inside the second tub and provides a space for storing the laundry; a second water supply part (not shown) for supplying wash water to the second tub; and a second drain part (not shown) for draining the wash water stored in the second tub out of the second cabinet 20.

<First Laundry Treating Apparatus>

Figure 2:
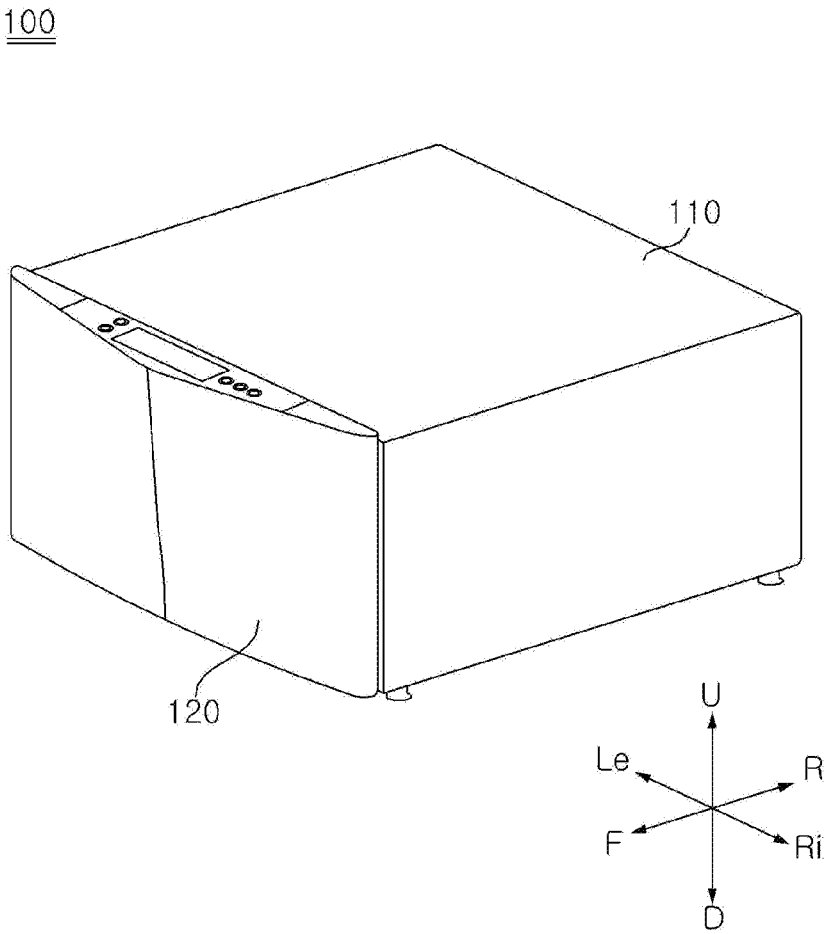
FIG. 2 is a perspective view of a first laundry treating apparatus according to an embodiment of the present disclosure.
Figure 3:
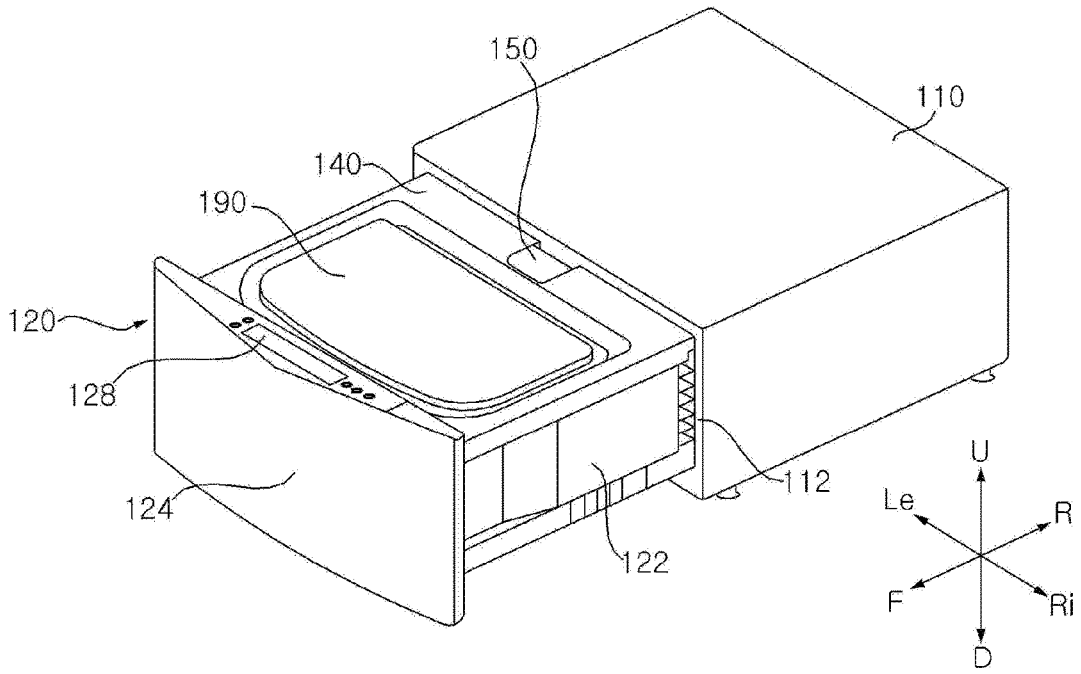
FIG. 3 is a perspective view of a first laundry treating apparatus in which a drawer is withdrawn, according to an embodiment of the present disclosure.
Figure 4:
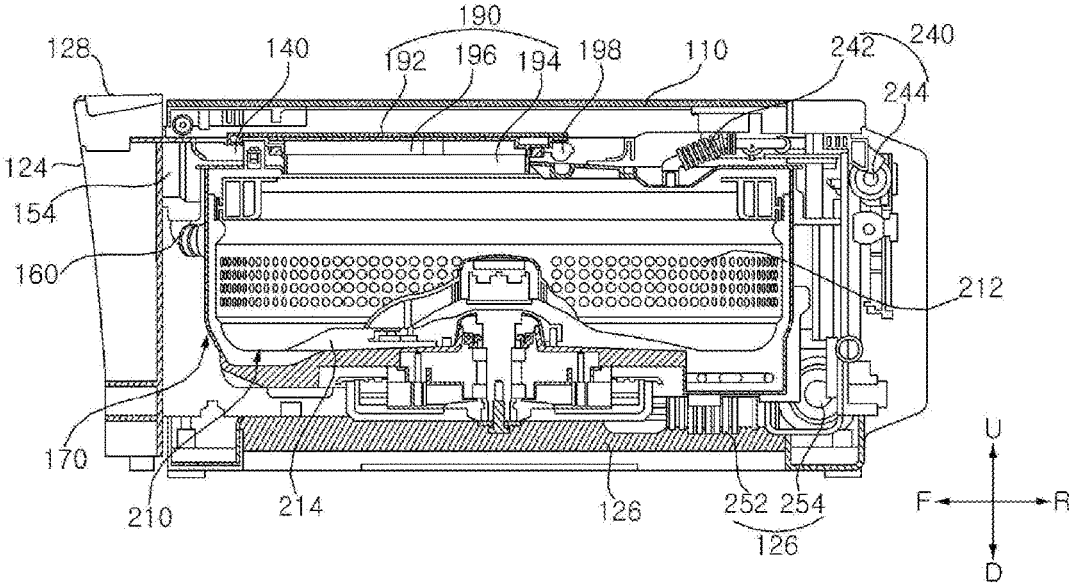
FIG. 4 is a cross-sectional view of a first laundry treating apparatus according to an embodiment of the present disclosure.
Figure 5:
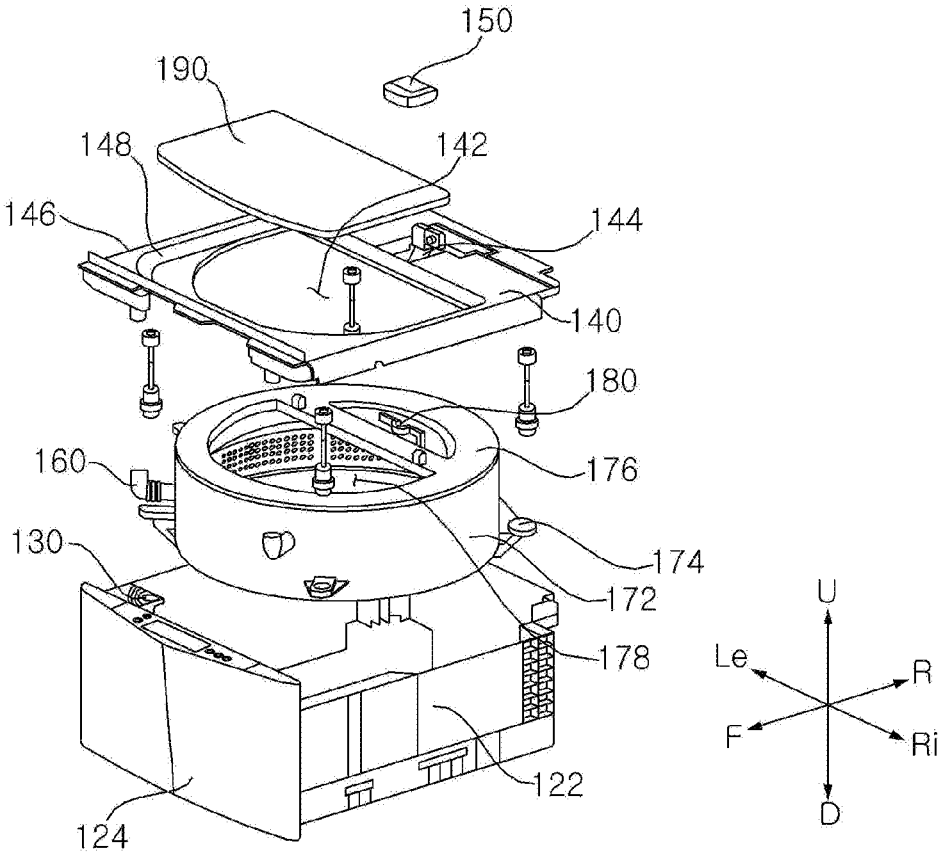
FIG. 5 is an exploded view of a drawer and parts disposed inside the drawer according to an embodiment of the present disclosure.
Figure 6:
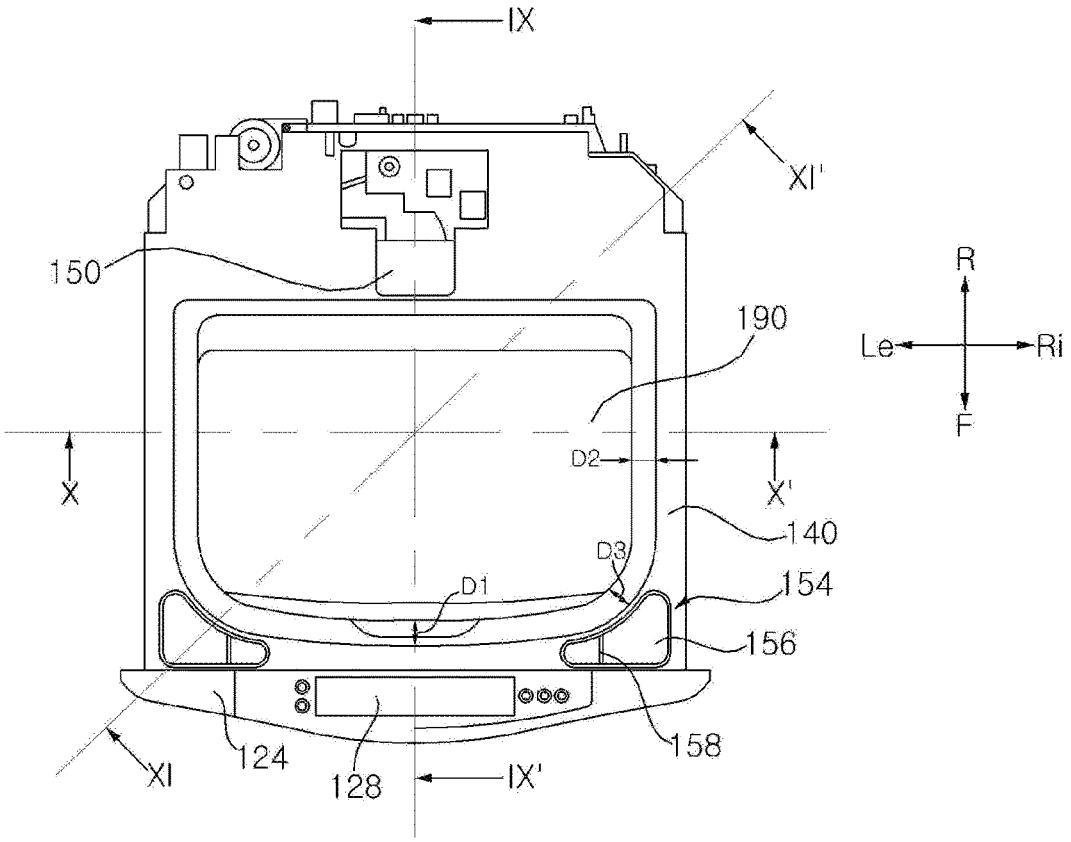
FIG. 6 is a plan view of a drawer according to an embodiment of the present disclosure.
Figure 7:
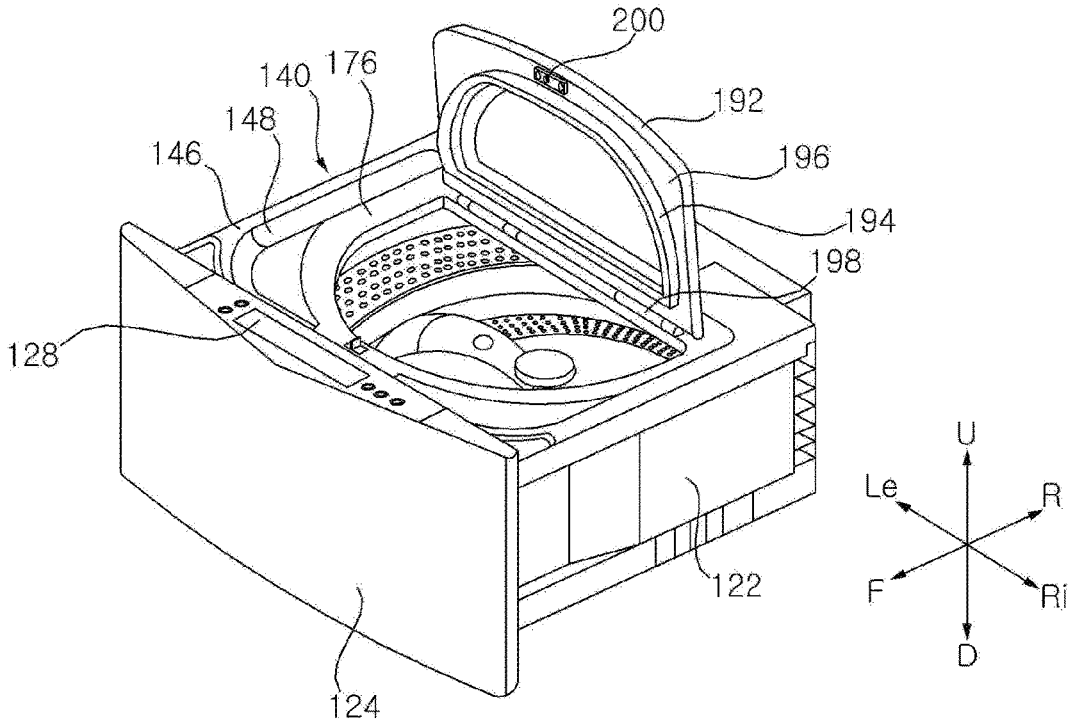
FIG. 7 is a view of a drawer when its door is open, according to an embodiment of the present disclosure.
Figure 8:
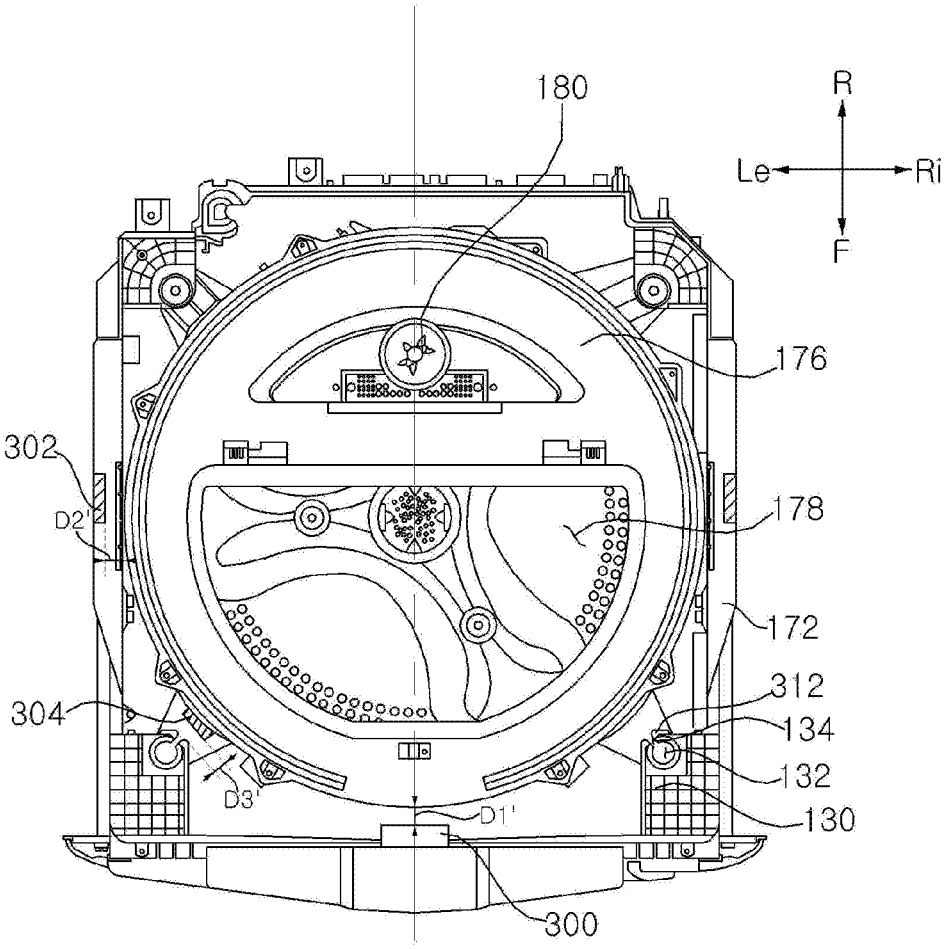
FIG. 8 is a plan view of a configuration of a drawer body and a tub according to an embodiment of the present disclosure.
Figure 9:
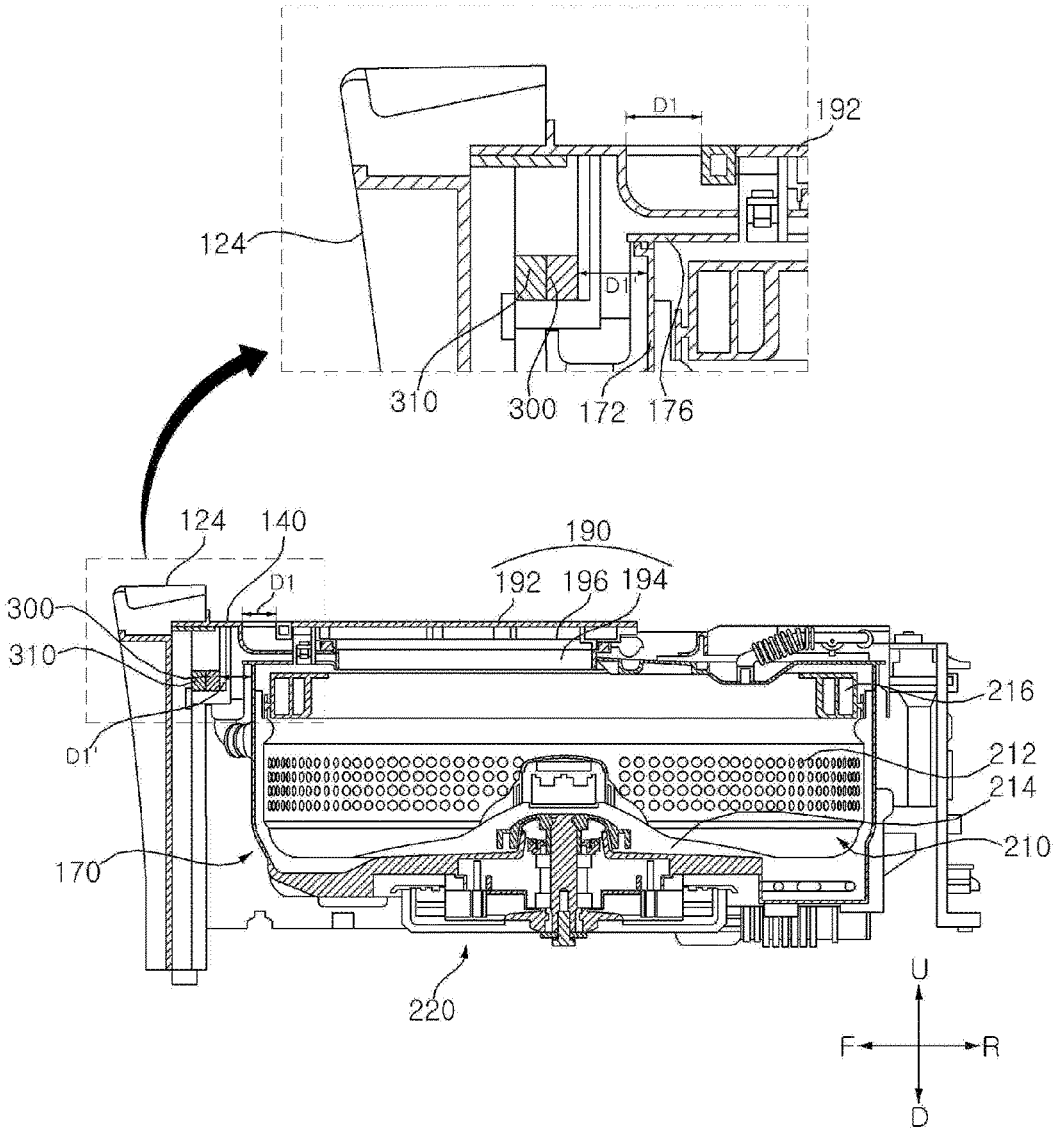
FIG. 9 is a cross-sectional view as taken along line IX-IX' of FIG. 6.
Figure 10:
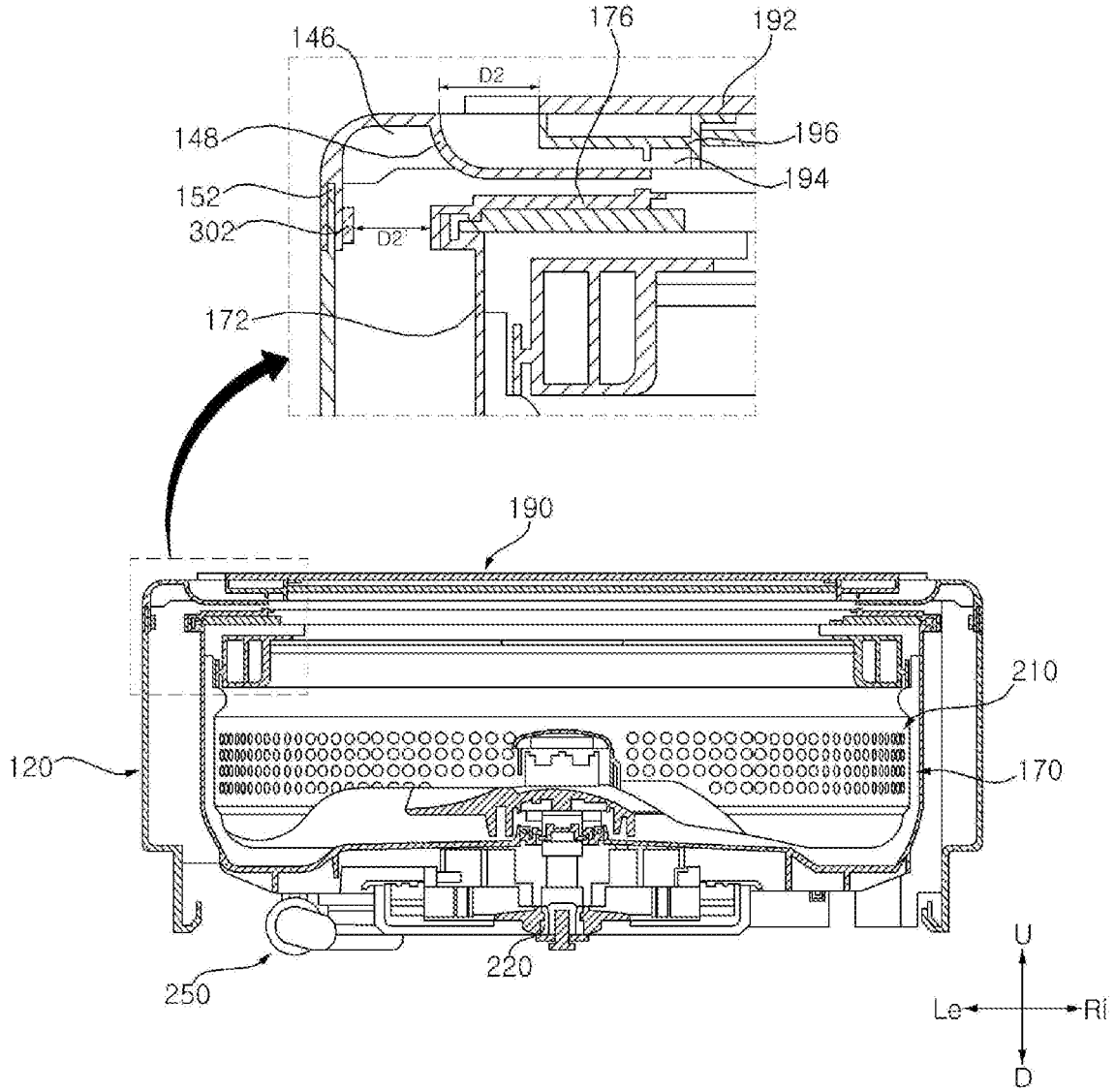
FIG. 10 is a cross-sectional view as taken along line X-X' of FIG. 6.
Figure 11:
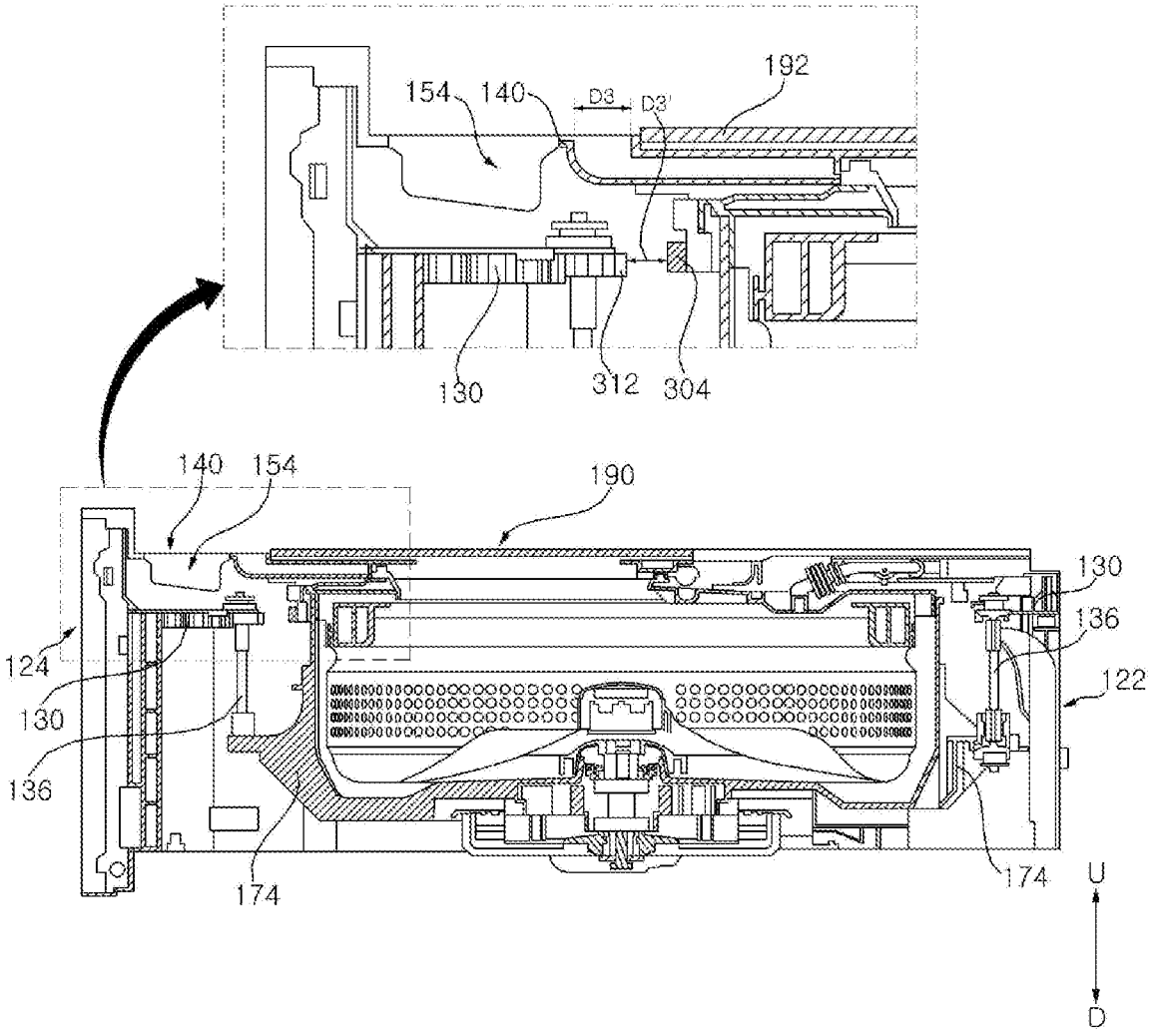
FIG. 11 is a cross-sectional view as taken along line XI-XI' of FIG. 6.

FIG. 2 is a perspective view of a first laundry treating apparatus according to an embodiment of the present disclosure. FIG. 3 is a perspective view of a first laundry treating apparatus in which a drawer is withdrawn, according to an embodiment of the present disclosure. FIG. 4 is a cross-sectional view of a first laundry treating apparatus according to an embodiment of the present disclosure. FIG. 5 is an exploded view of a drawer and parts disposed inside the drawer according to an embodiment of the present disclosure. FIG. 6 is a plan view of a drawer according to an embodiment of the present disclosure. FIG. 7 is a view of a drawer when its door is open, according to an embodiment of the present disclosure. FIG. 8 is a plan view of a configuration of a drawer body and a tub according to an embodiment of the present disclosure. FIG. 9 is a cross-sectional view as taken along line IX-IX' of FIG. 6. FIG. 10 is a cross-sectional view as taken along line X-X' of FIG. 6. FIG. 11 is a cross-sectional view as taken along line XI-XI' of FIG. 6.

Referring to FIGS. 2 to 11, the first laundry treating apparatus (hereinafter referred to as a "laundry treating apparatus") according to an embodiment of the present disclosure will be described below.

The laundry treating apparatus according to an embodiment of the present disclosure includes: a cabinet 110 which forms an exterior of the laundry treating apparatus, and has one open surface; a drawer 120 which is configured to be withdrawable from the open surface of the cabinet 110, and has an open top portion; a tub 170 which is disposed inside the drawer 120 and provides a space for storing wash water; a drum 210 which is rotatably disposed inside the tub 170; a door 190 which opens and closes an open top surface of the tub 170; a top cover 140 which covers the open top portion of the drawer 120, and is spaced apart from the door 190 by a predetermined distance along an outer circumference of the door 190; and a buffer which is disposed at the tub 170 or at a part facing the tub 170, so as to prevent contact between the top cover 140 and the door 190.

The laundry treating apparatus 100 may further include a plurality of suspensions 136 which are suspended from the drawer 120 of the tub 170. One end of the suspension 136 may be connected to an inner top portion of the drawer 120, and the other end thereof may be connected to an outer bottom portion of the tub 170.

The cabinet 110 forms an exterior of the laundry treating apparatus 100. The cabinet 110 has a space for accommodating the drawer 120. The cabinet 110 may have a box shape which has an open front (F) side.

The cabinet 110 may have a through-hole, which is formed on a rear surface of the cabinet 110. A portion of a water supply part 240 or a drain part 250, which will be described later, passes through the through-hole. In the embodiment, the cabinet 110 may have a base 126, which is separately mounted at a bottom surface of the cabinet 110.

The drawer 120 is configured to be withdrawable from the open front surface of the cabinet 120. In the embodiment, the drawer 120 may be accommodated inside the cabinet 110, or a portion of the drawer 120 may be withdrawn from the front (F) side of the cabinet 110.

In the embodiment, the drawer 120 has a space for accommodating the tub 170, and has an open top surface. The drawer 120 is provided to be movable along an inner surface of the cabinet 110. The drawer 120 includes: a drawer body 122 which forms a space for accommodating the tub 170 and is inserted into the cabinet 110; and a drawer panel 124 which is disposed at a front surface of the drawer body 122 and opens and closes the open front surface of the cabinet 110.

In the embodiment, the drawer body 122 has a drawer bracket 130, which is formed on the inside thereof, and to which the suspensions 136 are connected. The drawer bracket 130 protrudes from an inner top portion of the drawer body 122. Four drawer brackets 130 are formed at each inner edge of the drawer body 122. The drawer brackets 130 protrude toward the center of the tub 170.

In the embodiment, the drawer bracket 130 has a suspension hole 132 which is vertically open, and into which one side of the suspension 136 is inserted and supported. The drawer bracket 130 has a cut groove 134 formed in one direction to allow the suspension 136 to be mounted into the suspension hole 132.

In the embodiment, a portion of the drawer panel 124 is disposed to face a front edge portion 112 of the cabinet 110. The drawer panel 124 is disposed on a front surface of the drawer body 122. A portion of the drawer panel 124 comes into contact with the front edge portion 112 of the cabinet 110, so as to limit rearward (R) movement of the drawer body 122.

The drawer panel 124 may include a control panel 128 for inputting a control command related to the operation of the laundry treating apparatus 100, or outputting information related to the operation.

The top cover 140 is disposed on the top of the drawer body 122. The top cover 140 has an open inlet port 142, through which laundry is put into and taken out of the laundry treating apparatus. The top cover 140 is disposed along an outer circumference of the door 190, which will be described later, at a position spaced apart from the door 190 by a predetermined distance. The door 190, connected to the tub 170, may vibrate along with the tub 170 when the tub 170 vibrates. As the top cover 140 is spaced apart by a predetermine distance from the door 190 along the outer circumference of the door 190, the vibration of the tub 170, which is equal to or lower than a predetermined level, may not affect the top cover 140 or the door 190. Further, the top cover 140 may have a water supply through-hole 144, through which one side of the water supply part 240 passes.

At least one detergent introduction portion 154, which is formed to introduce detergent and the like into the tub 170, may be provided at a front surface of the top cover 140. In the embodiment, the detergent introduction portion 154 may be disposed on both front sides, which are adjacent to a user when the drawer 120 is withdrawn from the cabinet 110. The detergent introduction portion 154 may be disposed at each front edge of the top cover 140. The detergent introduction portion 154 includes: an introduction ball 156 which is recessed downward from the top cover 140; and an introduction hole 158, through which detergent and the like is introduced, and which is formed at one side of the introduction ball 156. The top cover 140 may protrude above the drawer body 122, so as to provide a storage space of the introduction ball 156.

The detergent introduction portion 154 is connected to the tub 170 through a detergent introduction tube 160. Accordingly, detergent and the like, which are introduced into the detergent introduction portion 154, are fed into the tub 170 through the detergent introduction tube 160.

In the embodiment, a coupling rib 152, which is coupled to the drawer 120, is formed on an outer edge of the top cover 140. A front side of the top cover 140 is coupled to the drawer panel 124, and both sides Le and Ri and a rear side R of the top cover 140 are coupled to the drawer body 122. Both sides and a rear end portion of the top cover 140 are bent toward the drawer body 122, and the coupling rib 152 coupled to the drawer body 122 is formed thereon.

In the embodiment, the top cover 140 covers the top of the tub 170 at portions other than the door 190. The top cover 140 has a top portion 146, which is formed to be flat at the top of the drawer 120, and a curved portion 148 which is bent downward from the top portion 146, to be curved concavely toward the door 190.

The top portion 146 of the top cover 140 is spaced apart by a predetermined distance from a door panel 192 of the door 190 which will be described later. The top portion 146 is positioned approximately at the same height as the door panel 192, and is spaced apart from the door panel 192 by a predetermined distance. The top portion 146 of the top cover 140 is positioned approximately at the same height as the door panel 192, so as to allow the introduction ball 156 of the detergent introduction portion 154 may have a space for temporarily storing detergent and the like which are fed thereinto.

The curved portion 148 is curved downward from the door panel 192 to be disposed below the door panel 192, and to cover the top of the tub 170.

The tub 170 provides a space for accommodating wash water for treating laundry. The tub 170 is disposed inside the drawer 120. The tub 170 has a hollow inner portion, and has a cylindrical shape with a partially open top.

The tub 170 includes: a tub body 172 which forms a space for accommodating water and has an open top portion; and a tub cover 176 which forms a top surface of the tub body 172.

In the embodiment, the tub body 172 has a cylindrical shape with an open top. A bottom portion of the tub body 172 is connected to the drain part 250 which drains wash water stored in the tub 170. A tub bracket 174, to which the suspension 136 is connected, is formed on an outer circumference of the tub body 172.

The tub bracket 174 is disposed below a circumferential surface of the tub 170. The tub bracket 174 is disposed at a position corresponding to each of a plurality of drawer brackets 130. The suspension 136 is connected to the tub bracket 174 and the drawer bracket 130 of the drawer 120, thereby connecting the tub 170 and the drawer 120.

A laundry inlet 178, which communicates the inside of the tub body 172 with the outside thereof, is formed at the tub cover 176. The laundry inlet 178 may be formed below the inlet port 142 formed at the top cover 140. A water supply port 180, through which water is supplied into the tub body 172, is formed at the tub cover 176. The water supply port 180 may be disposed below the water supply through-hole 144 formed at the top cover 140.

The door 190, which opens and closes the laundry inlet 178, is disposed at the top of the laundry inlet 178 of the tub cover 176.

The door 190 is rotatably disposed at the top of the tub cover 176. The door 190 is hingedly fixed to the top of the tub cover 176. The door 190 may open the laundry inlet 178 of the tub cover 176 to communicate the inside of the tub body 172 with the outside thereof, or may close the laundry inlet 178 to seal the tub 170 so that water inside the tub 170 may not leak to the outside.

The door 190 includes: a door panel 192 which covers the open top of the tub 170; a sealing member 194 which seals a space between the tub 170 and the door 190 when the door 190 closes the laundry inlet 178 of the tub 170; and a connection member 196 which hingedly fixes the door panel 192 to the tub 170, and has the sealing member 194 mounted on one side. The door 190 may further include a hinge portion 198 which is disposed on one side of the door panel 192, and hingedly fixes the door panel 192 to one side of the tub cover 176. The hinge portion 198 may be disposed on a rear side of the connection member 196.

When the door 190 closes the laundry inlet 178 of the tub 170, the door 190 may further include a fixing member 200 which is fixed to one side of the tub 170 of the door 190. In the embodiment, the fixing member 200 is disposed at a front portion of the connection member 196. The fixing member 200 may be a one-touch click button, which is locked and unlocked when the button is pressed.

The door panel 192 may open and close the laundry inlet 178 of the tub cover 176. In the embodiment, the door panel 192 is formed to be larger than an area of the laundry inlet 178 of the tub cover 176.

The sealing member 194 is disposed below the door panel 192. When the door 190 closes the laundry inlet 178 of the tub cover 176, the sealing member 194 seals a space between the door panel 192 and the tub cover 176.

The drum 210 is rotatably disposed inside the tub 170. In the embodiment, the drum has a cylindrical shape with an open top. The open top of the drum 210 is disposed below the laundry inlet 178 of the tub 170. In the embodiment, the drum 210 may include a balancer 216 for preventing excessive vibration, which occurs when laundry in the drum 210 leans to one side during rotation of the drum 210 by the driving part 220.

The drum 210 has a plurality of communication holes 212, which are formed on a bottom surface and a circumferential surface of the drum 210, to communicate the inside of the drum 210 with the tub 170. The drum 210 rotates inside the tub 170 by the driving part 220. In the embodiment, at least one washing protrusion 214 is formed at the bottom surface of the drum 210. The washing protrusion 214 protrudes from the bottom surface of the drum 210 and forms a water flow when the drum 210 rotates.

The driving part 220 includes: a stator 222; a rotor 224 which rotates with a rotating magnetic field provided by the stator 222; and a rotation axis 226 which transfers torque of the rotor 224 to the drum 210.

The laundry treating apparatus according to an embodiment of the present disclosure further includes: the water supply part 240 which supplies water into the tub 170; and the drain part 250 which drains wash water stored in the tub 170 to the outside.

The water supply part 240 includes: a water supply pipe 242 which is connected to the water supply through-hole 144 of the tub cover 176; and a water supply valve 244 which supplies or blocks water to the water supply pipe 242. The water supply pipe 242 may have a corrugated tube formed at a portion thereof, to prevent the water supply pipe 242 from being separated from the tub 170 by vibrations of the tub 170, or to adjust the length of the water supply pipe 242 when the drawer 120 is withdrawn. In the embodiment, when the drawer 120 is withdrawn, the top cover 140 may further include a water supply hole cover 150, to prevent a portion of the water supply pipe 242 from being exposed to the outside.

The drain part 250 may further include a drain pipe 252 which is disposed below the tub 170, and forms a drain passage; and a drain pump 254 which pumps wash water flowing through the drain passage to the outside of the laundry treating apparatus 100. The drain part 250 may be interposed between the tub 170 and the drawer 120. In the embodiment, the drain pipe 252 may have a corrugated tube formed at a portion thereof, to prevent the drain pipe 252 from being separated from the tub 170 by vibrations of the tub 170, or to adjust the length of the drain pipe 252 when the drawer 120 is withdrawn.

<Relationship Between the Door and the Top Cover>

In the embodiment, the top cover 140 is spaced apart from the door 190 by a predetermined distance along an outer circumference of the door 190. The door 190 is disposed adjacent to the top portion 146 of the top cover 140 at an edge portion of the door panel 192. The door 190 is disposed closest to the top cover 140 at a front end and ends of both sides in a front and rear (F-R) direction and a left and right (Le-Ri) direction.

In the embodiment, a buffer prevents the door 190 from coming into contact with the top cover 140 when the door 190 is moved by vibrations of the tub 170. The buffer is disposed on an outer circumference of the tub 170 or at a part facing the tub 170. The part facing the tub 170 may refer to the drawer 120, which is spaced apart from the tub 170 by a predetermined distance on an outer circumference of the tub 170, or an inner surface of the top cover 140 which is coupled to the top of the drawer 120.

In the laundry treating apparatus 100 according to an embodiment of the present disclosure, gaps D1 and D2 between the tub 170 and the buffers 300 and 302, or a gap D3 between a part 120 facing the tub 170 and the buffer 304 are maintained to be narrower than gaps D1', D2', and D3' between the door 190 and the top cover 140.

In the embodiment, the buffers 300, 302, and 304 may be made of a material which may be deformed by an external force to attenuate or absorb external shock. The buffer may attenuate or absorb shock caused by the contact between the tub 170 and the drawer 120, thereby reducing noise generated by the vibration of the tub 170.

Even when the buffers 300, 302, 304 are deformed, the gaps D1 and D2 between the tub 170 and the buffers 300 and 302, or the gap D3 between the part 120 facing the tub 170 and the buffer 304 are maintained to be narrower than the gap between the door 190 and the top cover 140.

Referring to FIG. 9, the buffer 300 may be disposed on an inner surface of the drawer 120 facing the outer circumference of the tub 170. In the embodiment, the buffer 300 may be disposed on an inner surface of the drawer panel 124

Referring to FIG. 10, the buffer 302 may be disposed at the top cover 140 facing the outer circumference of the tub 170. In the embodiment, the buffer 302 may be disposed at the coupling rib 152 of the top cover 140.

Referring to FIG. 11, the buffer 304 may be disposed on an outer circumference of the tub 170.

The buffer according to an embodiment of the present disclosure may include: the first buffer 300 which prevents the door 190 and the top cover 140 from coming into contact with each other when the door 190 moves forward F; the second buffer 302 which prevents the door 190 and the top cover 140 from coming into contact with each other when the door 190 moves leftward and rightward Le-Ri; and the third buffer 304 which prevents the door 190 and the top cover 140 from coming into contact with each other when the door 190 moves in a direction between forward F and leftward and the rightward Le-Ri movements.

Referring to FIG. 8, the first buffer 300 prevents contact between a front portion of the door 190 and the top cover 140. In the embodiment, the first buffer 300 is disposed on an inner surface of the drawer panel 124 which is disposed in front of the tub 170.

Referring to FIG. 8, the second buffer 300 prevents contact between both sides of the door 190 and the top cover 140. The second buffer 302 is disposed at an inner surface of the drawer body 122, which is disposed on both sides of the tub 170, or an inner surface of the top cover 140. The second buffer 302 may be disposed on each of a left inner surface and a right inner surface of the top cover 140. In the embodiment, the second buffer 302 may be disposed on one side of the coupling rib 152 of the top cover 140 which is coupled to the drawer body 122.

Referring to FIG. 8, the third buffer 304 prevents a front diagonal portion between the front portion and the both side portions of the door 190 from coming into contact with the top cover 140. In the embodiment, the third buffer 304 is disposed on an outer circumference of the tub 170. The third buffer 304 is disposed on an outer circumferential surface of the tub 170 facing the drawer bracket 130 formed on the inside of the drawer 120. When the tub 170 moves, an end portion of the drawer bracket 130 and the third buffer 304 may come into contact with each other.

The laundry treating apparatus 100 according to an embodiment of the present disclosure may further include a protrusion member which narrows a gap between the tub 170 and the buffer or a gap between a part facing the tub 170 and the buffer. The protrusion member is disposed to come into contact with the buffer, or with a part facing the buffer. In the embodiment, unlike the buffer, the protrusion member may be made of a material which is not deformed even under external force, so as to maintain a gap between the tub 170 and the buffer or the part facing the tub 170 and the buffer.

Referring to FIG. 11, the protrusion member 312 according to an embodiment of the present disclosure may be disposed at an end portion of the drawer bracket 130 of the drawer 120. When the tub 170 vibrates, the protrusion member 312 may come into contact with the buffer 304 disposed at the tub 170.

Referring to FIG. 9, the protrusion member 310 may be disposed on an inner surface of the drawer 120. The protrusion member 310 is disposed on an inner surface of the drawer panel 124. The protrusion member 310 may be interposed between the drawer panel 124 and the buffer 300.

In the embodiment, the protrusion member may include: a first protrusion member 310 which narrows a gap between the first buffer 300 and the tub 170; and a second protrusion member 312 which is disposed at an end portion of the drawer bracket 130 opposing the third buffer 304. The second protrusion member 312 narrows a gap between the drawer bracket 130 and the tub 170.

Referring to FIGS. 6 and 8, the first protrusion member 310 is interposed between the drawer panel 124 and the first buffer 300, such that the gap D1' between the first buffer 300 and the tub 170 is formed to be narrower than the gap D1 between the front portion of the door 190 and the top cover 140 (D1>D1'). As the second buffer 302 is disposed at the coupling rib 152 of the top cover 140, the gap D2' between the second buffer 302 and the tub 170 is formed to be narrower than the gap D2 between both lateral portions of the door 190 and the top cover 140 (D2>D2').

Further, as the third buffer 304 is disposed at an outer circumferential surface of the tub 170, and the second protrusion member 312 is disposed at an end portion of the drawer bracket 130 of the drawer 120, the gap D3' between the third buffer 304 disposed at an outer circumferential surface of the tub 170 and the second protrusion member 312 disposed at an end portion of the drawer bracket 130 is formed to be narrower than the gap D3 between the door 190 and the top cover 140 (D3>D3').

While the present disclosure has been shown and described with reference to the exemplary embodiments thereof, it should be understood that the present disclosure is not limited to the specific embodiments, and various modifications and variations may be made by those skilled in the art without departing from the scope and spirit of the invention as defined by the appended claims, and the modified implementations should not be construed independently of the technical idea or prospect of the present disclosure.

What is claimed is:

1. A laundry treating apparatus, comprising:

a cabinet that defines an exterior of the laundry treating apparatus, the cabinet having a side surface that defines a cabinet opening;

a drawer configured to be inserted into and withdrawn from the cabinet through the cabinet opening, the drawer defining a drawer opening at an upper side of the drawer;

a tub that is located inside the drawer, that faces a part of the drawer, and that defines a space configured to store wash water, the tub defining a tub opening at an upper side of the tub;

a drum located inside the tub and configured to rotate with respect to the tub;

a door configured to open and close the tub opening;

a top cover configured to cover the drawer opening, the top cover being spaced apart from the door by a predetermined distance and extending along an outer circumference of the door; and a buffer that is located at the tub or at the part of the drawer facing the tub, wherein a gap between the tub and the buffer or a gap between the buffer and the part of the drawer is narrower than a gap between the top cover and the door.

2. The laundry treating apparatus of claim 1, further comprising a protrusion member located between the part of the drawer and the buffer or located between the tub and the buffer such that the gap between the tub and the buffer or the gap between the buffer and the part of the drawer is narrower than the gap between the top cover and the door.

3. The laundry treating apparatus of claim 2, wherein a hardness level of the protrusion member is greater than a hardness level of the buffer.

4. The laundry treating apparatus of claim 1, wherein the buffer is located at an inner surface of the drawer that faces an outer circumferential surface of the tub.

5. The laundry treating apparatus of claim 4, further comprising a protrusion member located between the drawer and the buffer such that the gap between the buffer and the tub is narrower than the gap between the top cover and the door.

6. The laundry treating apparatus of claim 1, wherein the buffer is located at an outer circumferential surface of the tub.

7. The laundry treating apparatus of claim 6, further comprising a protrusion member located at an inner surface of the drawer that faces the buffer, wherein a gap between the protrusion member and the buffer is narrower than the gap between the top cover and the door.

8. The laundry treating apparatus of claim 1, wherein the buffer is located at an inner surface of the top cover, the top cover being coupled to a top portion of the drawer.

9. The laundry treating apparatus of claim 1, wherein the buffer comprises:

a first buffer configured to limit contact between the door and the top cover based on the door moving in a front-back direction relative to the top cover;

a second buffer configured to limit contact between the door and the top cover based on the door moving in a left-right direction relative to the top cover; and a third buffer configured to limit contact the door and the top cover based on the door moving in a diagonal direction between the front-back direction and the left-right direction relative to the top cover.

10. The laundry treating apparatus of claim 9, further comprising a suspension part that supports the tub, wherein the drawer comprises a drawer bracket that protrudes to an inside of the drawer and that is connected to the suspension part, and wherein the third buffer is located at an outer circumferential surface of the tub that faces the drawer bracket.

11. The laundry treating apparatus of claim 10, further comprising:

a first protrusion member located between the first buffer and the tub; and a second protrusion member located at an end portion of the drawer bracket that faces the third buffer.

12. The laundry treating apparatus of claim 9, wherein the door has a front end portion that is spaced apart from the top cover, and wherein a gap between the first buffer and the tub is narrower than a gap between the front end portion of the door and the top cover.

13. The laundry treating apparatus of claim 9, wherein the door has a lateral end portion that is spaced apart from the top cover, and wherein a gap between the second buffer and the tub is narrower than a gap between the lateral end portion of the door and the top cover.

14. The laundry treating apparatus of claim 11, wherein the door has a front lateral end portion that is spaced apart from the top cover, and wherein a gap between the third buffer and the second protrusion member is narrower than a gap between the front lateral end portion of the door and the top cover.

15. The laundry treating apparatus of claim 1, wherein the buffer comprises a plurality of buffers that are located at one or more surfaces of the drawer that face an outer circumferential surface of the tub.

16. The laundry treating apparatus of claim 1, wherein the buffer comprises a plurality of buffers that are located at an outer circumferential surface of the tub that faces one or more surfaces of the drawer.

17. The laundry treating apparatus of claim 1, wherein the top cover extends upward toward the door, and wherein an upper end of the top cover and the outer circumference of the door are spaced apart from each other by the predetermined distance.

18. The laundry treating apparatus of claim 17, wherein the buffer is located at an outer circumferential surface of the tub that faces an inner surface of the drawer, and wherein a distance between the buffer and the inner surface of the drawer is less than the predetermined distance.

19. The laundry treating apparatus of claim 17, wherein the buffer is located at an inner surface of the drawer that faces an outer circumferential surface of the tub, and wherein a distance between the buffer and the outer circumferential surface of the tub is less than the predetermined distance.

20. The laundry treating apparatus of claim 1, wherein a horizontal distance corresponding to the gap between the tub and the buffer or the gap between the buffer and the part of the drawer is less than the predetermined distance between the top cover and the door.

* * * * *